US010208440B1

(12) United States Patent
Honeycutt

(10) Patent No.: US 10,208,440 B1
(45) Date of Patent: Feb. 19, 2019

(54) TRAFFIC GATE

(71) Applicant: Safe Rack LLC, Andrews, SC (US)

(72) Inventor: Robert W. Honeycutt, Pawleys Island, SC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 15/261,159

(22) Filed: Sep. 9, 2016

Related U.S. Application Data

(60) Provisional application No. 62/216,165, filed on Sep. 9, 2015.

(51) Int. Cl.
*E01F 13/06* (2006.01)
*E06B 11/02* (2006.01)
*E05F 15/60* (2015.01)

(52) U.S. Cl.
CPC ..... *E01F 13/06* (2013.01); *E05F 15/60* (2015.01); *E06B 11/025* (2013.01); *E05Y 2900/402* (2013.01)

(58) Field of Classification Search
CPC .. E01F 13/06; E01F 13/048; E05Y 2900/402; E05Y 2900/40; B61L 29/04; E06B 11/025; E05F 1/1215; E05F 1/1207
See application file for complete search history.

(56) References Cited

U.S. PATENT DOCUMENTS 1,933,244 A 10/1933 Denny
4,434,578 A * 3/1984 Rumpz ..... E01F 13/06 49/334
4,519,164 A * 5/1985 Porter ..... E06B 11/04 49/108
4,658,543 A * 4/1987 Carr ..... E01F 13/06 49/139
4,844,653 A * 7/1989 Dickinson ..... E01F 13/06 404/6

(Continued)

FOREIGN PATENT DOCUMENTS

DE 3428218 A1 3/1985
EP 1640503 A1 3/2006

(Continued)

OTHER PUBLICATIONS

"YellowGate XL" Sales Sheet, created May 2015, all enclosed pages cited.

*Primary Examiner* — Justin B Rephann
(74) *Attorney, Agent, or Firm* — Nelson Mullins Riley & Scarborough, LLP

(57) ABSTRACT

A traffic gate apparatus comprises an upstanding pedestal. A first elongate arm is also provided having a proximal end and a distal end, with the proximal end of the first elongate arm being pivotally connected to the pedestal at a first pivot axis. A second elongate arm has a proximal end and a distal end, with the proximal end of the lower elongate arm being pivotally connected to the pedestal at a second pivot axis. The second pivot axis is below the first pivot axis such that the first and second elongate arms are movable between a lowered position, in which the first and second elongate arms are generally horizontal and parallel with the first elongate arm being above said second elongate arm, and a raised position. The first and second elongate arms each have an adjustment mechanism such that a length thereof can be varied.

24 Claims, 8 Drawing Sheets

(56) References Cited

U.S. PATENT DOCUMENTS

| | | | | |
|---|---|---|---|---|
| 5,136,810 | A * | 8/1992 | DeWitt, III | E01F 13/06 49/141 |
| 5,299,386 | A | 4/1994 | Naegelli et al. | |
| 5,984,569 | A | 11/1999 | Chou | |
| 5,997,211 | A * | 12/1999 | Chou | E01F 13/12 256/13.1 |
| 6,115,963 | A * | 9/2000 | Allardyce | E01F 13/06 49/226 |
| 6,119,399 | A | 9/2000 | McCain et al. | |
| 6,796,084 | B2 | 9/2004 | Gagon | |
| 7,000,673 | B2 * | 2/2006 | Cook | E06B 11/02 160/210 |
| 7,384,017 | B1 | 6/2008 | Burke et al. | |
| 9,032,666 | B2 | 5/2015 | Honeycutt et al. | |
| 2003/0019158 | A1 * | 1/2003 | Gagnon | E01F 13/06 49/227 |
| 2003/0159356 | A1 * | 8/2003 | Russell | E01F 13/06 49/226 |
| 2005/0060936 | A1 | 3/2005 | Burke | |
| 2006/0228177 | A1 * | 10/2006 | Allain | E01F 13/06 404/6 |
| 2008/0000156 | A1 * | 1/2008 | Stoffels | E01F 13/06 49/49 |
| 2008/0038055 | A1 * | 2/2008 | Jankovsky | E01F 13/048 404/6 |
| 2012/0011774 | A1 * | 1/2012 | Arnaud | E01F 13/06 49/49 |
| 2013/0071182 | A1 | 3/2013 | Younce et al. | |
| 2013/0219790 | A1 * | 8/2013 | Honeycutt | E06B 11/045 49/176 |
| 2014/0360680 | A1 * | 12/2014 | Burgin | B61L 29/04 160/160 |
| 2016/0002870 | A1 | 1/2016 | Younce et al. | |
| 2017/0198448 | A1 * | 7/2017 | Han | E01F 13/06 |

FOREIGN PATENT DOCUMENTS

| | | | |
|---|---|---|---|
| FR | 2886656 | A1 | 12/2006 |
| GB | 2404413 | A | 2/2005 |
| JP | H05239981 | A | 9/1993 |

* cited by examiner

TRAFFIC GATE

PRIORITY CLAIM

This application is based upon and claims the benefit of U.S. provisional application Ser. No. 62/216,165, filed Sep. 9, 2015. The foregoing application is relied upon and incorporated herein by reference in its entirety for all purposes.

FIELD OF THE INVENTION

The present invention relates to traffic gates used to control flow of vehicles by a designated location.

BACKGROUND OF THE INVENTION

Traffic gates are used in a variety of situations to control flow of vehicles. For example, such gates may be used at entry checkpoints into parking areas of secure facilities, such as government buildings. Parking lots that require payment of a parking fee, such as airport parking lots, will also often use traffic gates at points of entry and exit. Similarly, private residential communities often use traffic gates to limit entry into the community to the residents themselves and their guests.

Typical traffic gates comprise a simple crossing arm of predetermined length. In many cases, the arm may not be long enough to reach all the way across a road, thus tempting drivers to try going around them. These efforts frequently result in damage to the crossing arm itself, requiring an expensive replacement. In addition, traditional crossing arms are often small and difficult to see, which also leads to problems.

SUMMARY OF THE INVENTION

The present invention recognizes and addresses the foregoing considerations, and others, of prior art construction and methods.

In this regard, one aspect of the present invention provides a traffic gate apparatus comprising an upstanding pedestal. A first elongate arm is also provided having a proximal end and a distal end, with the proximal end of the first elongate arm being pivotally connected to the pedestal at a first pivot axis. A second elongate arm has a proximal end and a distal end, with the proximal end of the second elongate arm being pivotally connected to the pedestal at a second pivot axis. The second pivot axis is below the first pivot axis such that the first and second elongate arms are movable between a lowered position, in which the first and second elongate arms are generally horizontal and parallel with the first elongate arm being above the second elongate arm, and a raised position. The first and second elongate arms each have an adjustment mechanism such that a length thereof can be varied.

In some exemplary embodiments, the first and second elongate arms each have an arm element of fixed length which is pivotally connected to the pedestal and a corresponding extendible portion movable with respect to the arm element so as to vary a length of the elongate arm. For example, each of the first and second elongate arms may comprise first and second arm elements and first and second extendible portions. In addition, the first and second extendible portions for a respective arm may be interconnected via a respective connecting portion. Preferably, the first and second arm elements and the first and second extendible portions may be tubular, such that one of the first and second arm elements and a corresponding one of the first and second extendible portions are telescopically connected.

Embodiments are contemplated in which the extendible portions are slidably received in a corresponding one of the arm elements. The extendible portions may each carry a compressible member on an end thereof which has an increased diameter when axially compressed such that when the compressible member is adjusted it will engage against the interior surface of the arm element to fix the arm element and extendible portion with respect to one another. Preferably provided for each compressible member is a compressing fitting configured to adjust the compressible member by squeezing it in an axial direction so as to increase its diameter.

In some exemplary embodiments, a foot structure may be pivotally connected to the distal ends of the first and second elongate arms. Moreover, the arm elements and the extendible portions may be telescopically connected. Preferably, the length of the first and second elongate arms can be varied between about six feet and twelve feet.

Preferably, each of the first and second elongated arms are pivotally connected to the pedestal via corresponding first and second hinges. The hinges in such embodiments may each include an outer tubular element and an inner tubular element, the outer tubular element being fixed with respect to the pedestal and at least a portion of the inner tubular element being rotatable with respect to the outer tubular element. Preferably, the inner tubular element has an end portion that extends beyond the outer tubular element, a corresponding one of the first and second elongate arms being attached to the end portion. In some cases, it may be desirable to configure at least one of the inner tubular elements as a torsion spring having a fixed portion adjacent to the end portion.

In some embodiments, at least one of the inner tubular elements has a linkage connecting structure for allowing motorized operation. For example, a motor may be located in the pedestal and connected to the inner tubular element via a linkage.

According to other aspects, the present invention provides a traffic gate apparatus comprising an upstanding pedestal and a first elongate arm having parallel first and second arm elements. Proximal ends of the first and second arm elements are pivotally connected to the upstanding pedestal so as to pivot about a horizontal pivot axis at a first hinge. According to this aspect, the first hinge includes an outer tubular element and an inner tubular element, the outer tubular element being fixed with respect to the pedestal. The inner tubular element has first and second end portions extending beyond the outer tubular element, the first and second arm elements being attached to the first and second end portions of the inner tubular element. The inner tubular element further has a central portion fixed with respect to the outer tubular element, the central portion being separated from the first and second end portions by respective cuts such that the inner tubular element forms a torsion spring.

In accordance with exemplary embodiments, the cuts in the inner tubular element each have a generally spiral configuration. Moreover, the central portion of the inner tubular element defines at least one series of spaced apart holes about a circumference thereof for adjusting a preload applied to the first elongate arm. Preferably, the preload may allow lifting of the first elongate arm with less than 40 pounds of lifting force.

Embodiments are contemplated in which a second elongate arm is also provided. In such embodiments, the first and second elongate arms may preferably be generally horizontal and parallel in a lowered position, with the first elongate arm being above the second elongate arm.

The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
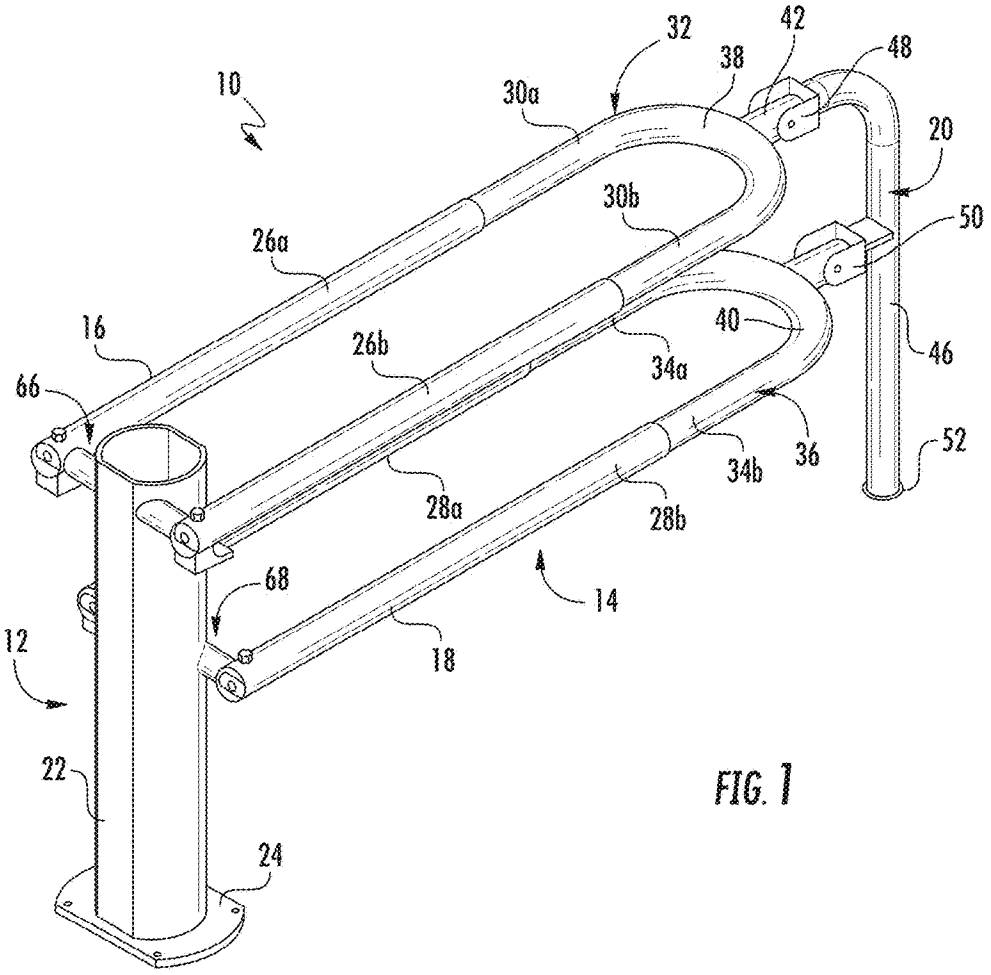
FIG. 1 is a perspective view of a traffic gate in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
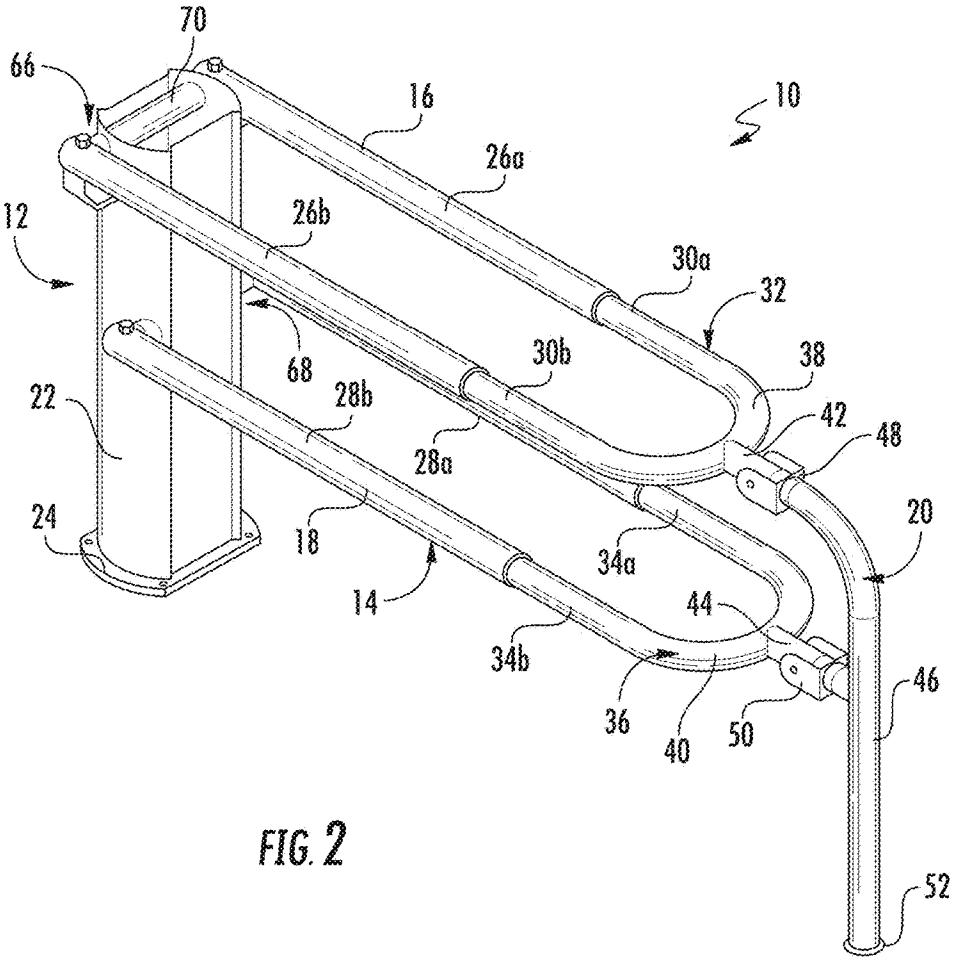
FIG. 2 is a further perspective view of the traffic gate of FIG. 1.
Figure 3:
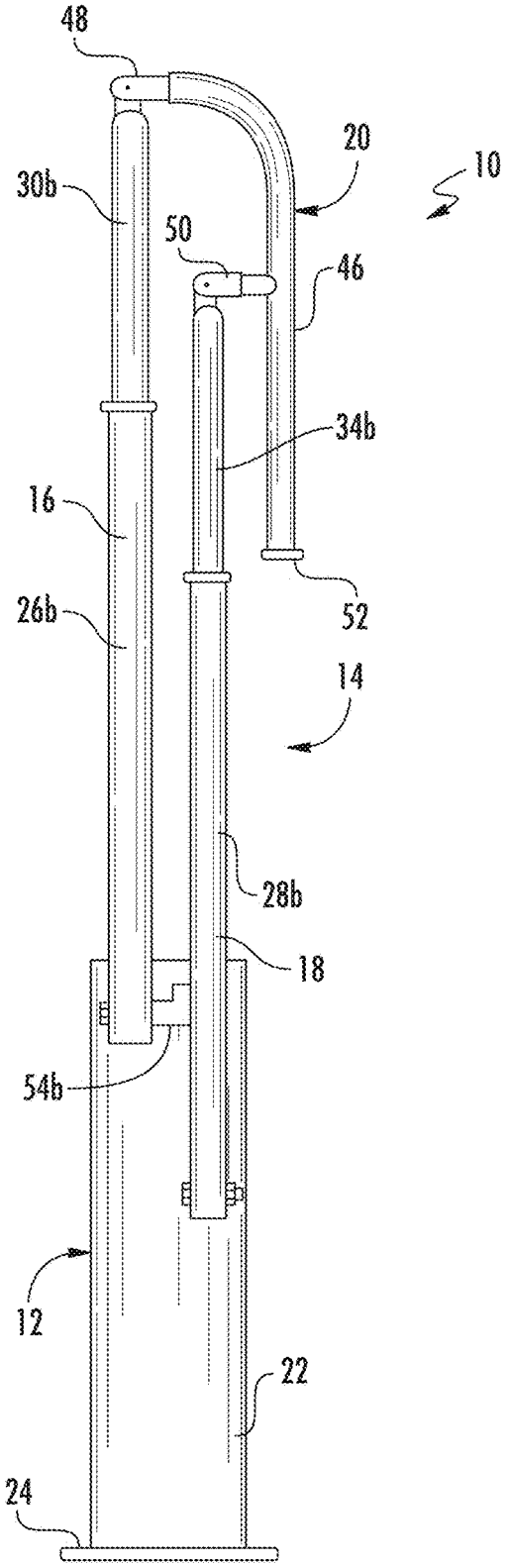
FIG. 3 is an elevational view of the traffic gate of FIG. 1 in raised position.

FIGS. 1-3 illustrate a traffic gate apparatus 10 constructed in accordance with an embodiment of the present invention. Apparatus 10 comprises an upstanding pedestal 12 that remains fixed during use and a pivotal arm assembly 14. In this embodiment, arm assembly 14 comprises a pair of substantially parallel arms 16 and 18 pivotally connected at their proximal ends to pedestal 12. A foot structure 20 is pivotally connected at the distal ends of arms 16 and 18.

In this embodiment, pedestal 12 comprises a vertical housing portion 22 that preferably has an open interior. A flange 24 may be located at the base of housing portion 22 to provide additional stability to pedestal 12. In addition, flange 24 may define one or more apertures for receipt of bolts or other suitable fasteners for anchoring purposes. Although the upper end of housing portion 22 is shown to be open in FIGS. 1 and 2, one skilled in the art will appreciate that it will often be desirable to cover or otherwise cap this open end, such as for environmental or aesthetic reasons.

As will be explained more fully below, arms 16 and 18 are preferably configured to adjust the effective width of gate apparatus 10 within a designated range. For example, in a preferred embodiment, the effective width of gate apparatus 10 can be adjusted continuously between about six and twelve feet. As a result, gate apparatus 10 can accommodate a variety of different road widths that may be encountered in use. In an exemplary embodiment, the height of upper parallel arm 16 may be about 42 inches in the lowered position.

In this embodiment, arms 16 and 18 are configured to extend their lengths in a manner that produces different gate widths as described above. Toward this end, upper arm 16 comprises a pair of tubular arm elements 26*a-b* in parallel with one another. Similarly, lower arm 18 includes a pair of tubular arm elements 28*a* and 28*b* in parallel with one another. Arm elements 26*a-b* telescopically receive respective tubular portions 30*a-b* of a distal arm structure 32. In a like manner, arm elements 28*a-b* telescopically receive respective tubular portions 34*a-b* of a distal arm structure 36. As will be explained, the tubular portions are extendible to allow adjustment of the gate width.

As can be seen most clearly in FIGS. 2 and 3, tubular portions 30*a* and 30*b* extend toward respective arm elements 26*a-b* from a connecting portion 38 of distal arm structure 32. Similarly, tubular portions 34*a* and 34*b* extend toward respective arm elements 28*a-b* from a connecting portion 40 of distal arm structure 36. In the illustrated embodiment, connecting portions 38 and 40 have an arcuate shape, although one skilled in the art will appreciate that any suitable configuration can be used. As can be seen, respective bosses 42 and 44 extend from connecting portions 38 and 40 for attachment of foot structure 20.

Foot structure 20 comprises a vertical post element 46 carrying a pair of attachment structures 48 and 50. Attachment structures 48 and 50 are pivotally connected to respective bosses 42 and 44. Thus, foot structure 20 will be pivotally connected to arms 16 and 18 as noted above. A resilient cap 52 may be located at the bottom of post element 46 to lessen impact damage as foot structure 20 comes into repeated contact with the roadway or other ground surface.

Gate apparatus 10 is shown in its lowered position in FIGS. 1 and 2. In this position, arms 16 and 18 are parallel, and foot structure 20 rests on the roadway surface. As a result, flow of traffic will be inhibited. In contrast, FIG. 3 shows gate apparatus 10 in the raised position to allow flow of traffic. As can be seen, arms 16 and 18 are substantially vertical in this position. Vertical post element 46 remains vertical because of the manner in which foot structure 20 is connected to arms 16 and 18.

In this regard, as can be seen in FIG. 3, the proximal pivot axis of upper arm 16 is above and behind the proximal pivot axis of lower arm 18. As a result, there is no physical interference between arms 16 and 18 as they are pivoted to the vertical raised position. A suitable bumper structure, such as bumpers 54*a-b* (FIG. 4), may be provided to stop arms 16 and 18 at vertical when they are raised. As will be explained more fully below, arm 16 and/or arm 18 are preferably spring-loaded to assist in raising and to produce a more gradual rate of descent when lowered.

Figure 5:
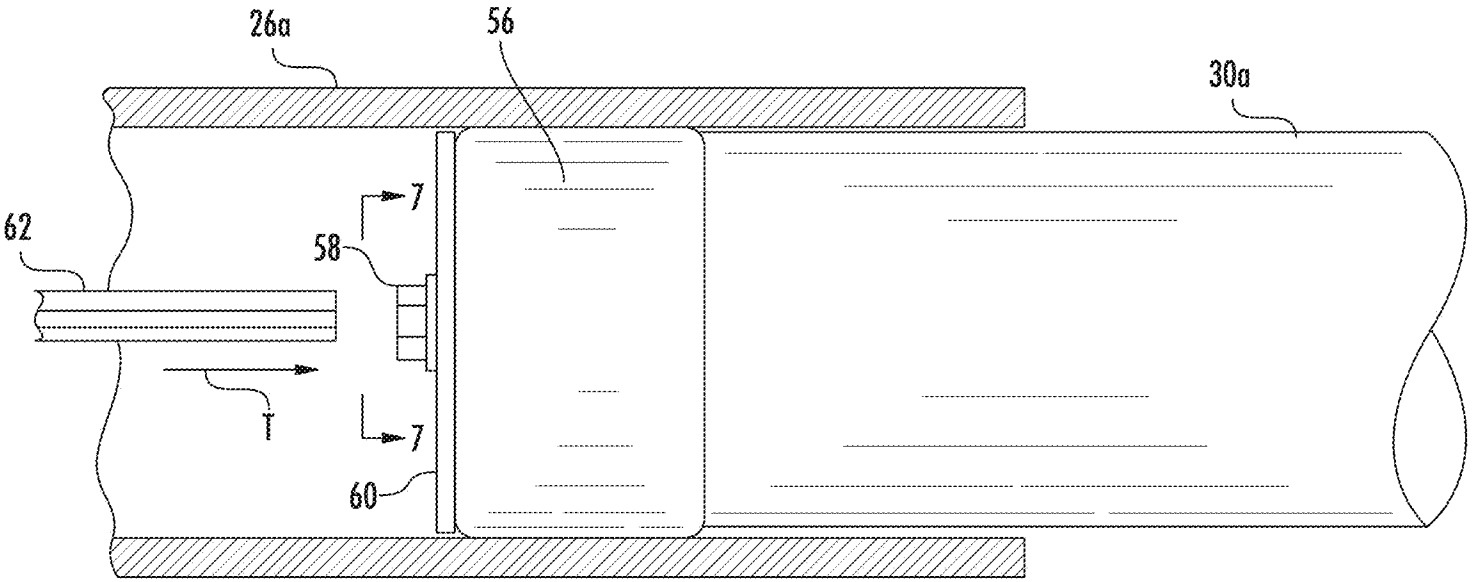
FIG. 5 is an enlarged partial cross-section view showing the manner in which arm length can be adjusted in accordance with a preferred embodiment.
Figure 6:
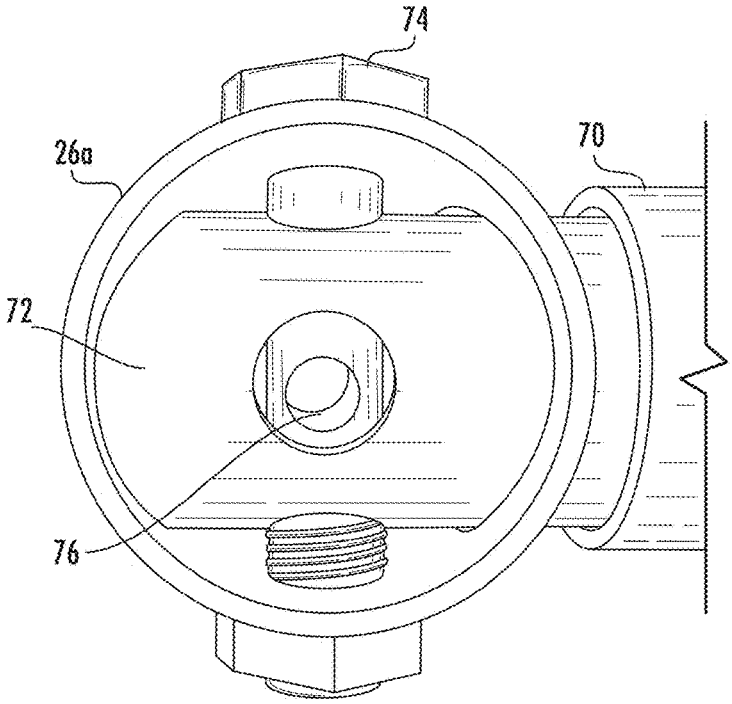
FIG. 6 is an enlarged end view of one proximal end of the pivotal arm assembly.
Figure 7:
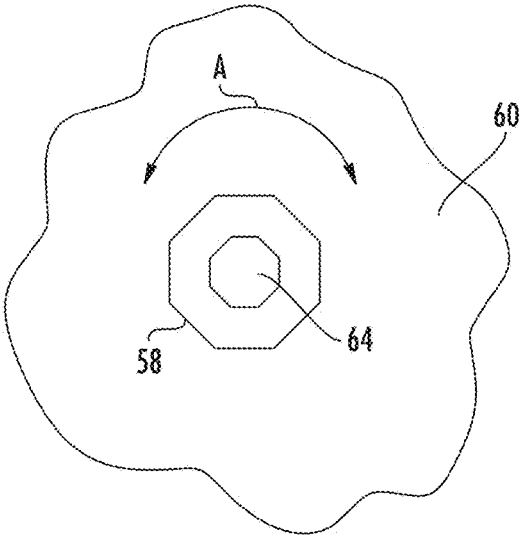
FIG. 7 is an enlarged fragmentary view of the area so indicated in FIG. 5.

Referring now to FIGS. 5 through 7, a preferred manner of adjusting the length of arms 16 and 18 will be described. In this example, adjustment of tubular portion 30*a* with respect to arm element 26*a* will be described. One skilled in the art will recognize, however, that other telescoping positions of arms 16 and 18 are preferably adjusted in a similar manner.

As can be seen, a compressible member 56 is located at the proximal end of tubular portion 30*a*, which is received in arm element 26*a*. Preferably, compressible member 56 is formed of rubber or another suitable resilient material so that it expands radially when it is axially compressed. In this state, arm element 26*a* and tubular portion 30*a* are locked in position with respect to one another. When the axial compression of compressible member 56 is relieved, its radius is reduced. In this state, tubular portion 30*a* may be moved telescopically with respect to arm element 26*a*.

In this embodiment, compressible member 56 is adjusted via a compressing fitting which causes the compressible member to be squeezed. For example, the compressing fitting may comprise a bolt 58 threadably received into a blind bore located in tubular portion 30. Preferably, bolt 58 may work against a rigid disc 60 which evenly distributes the compressive force on the face of compressible member 56. Bolt 58 may be rotated, as shown by arrow A in FIG. 7, using an elongate tool 62 inserted through the proximal end of the arm element. For example, tool 62 may comprise a hex wrench of suitable length that is received in a hexagonal-shaped recess 64 defined in the head of bolt 58. A self-centering disc (not shown) may be located between the proximal end of arm element 26*a* and bolt 58 to ensure that tool 60 correctly aligns with recess 64 as it is inserted (as shown by arrow T in FIG. 5). (It will be appreciated that some rotation of tool 60 may be necessary in order for it to seat in recess 64.)

The described adjustment mechanism is often preferred because it allows continuous adjustment of the length within a designated range. One skilled in the art will appreciate, however, that other suitable adjustment mechanisms may be used as necessary or desired, such as those that allow adjustment in discrete increments.

Figure 4:
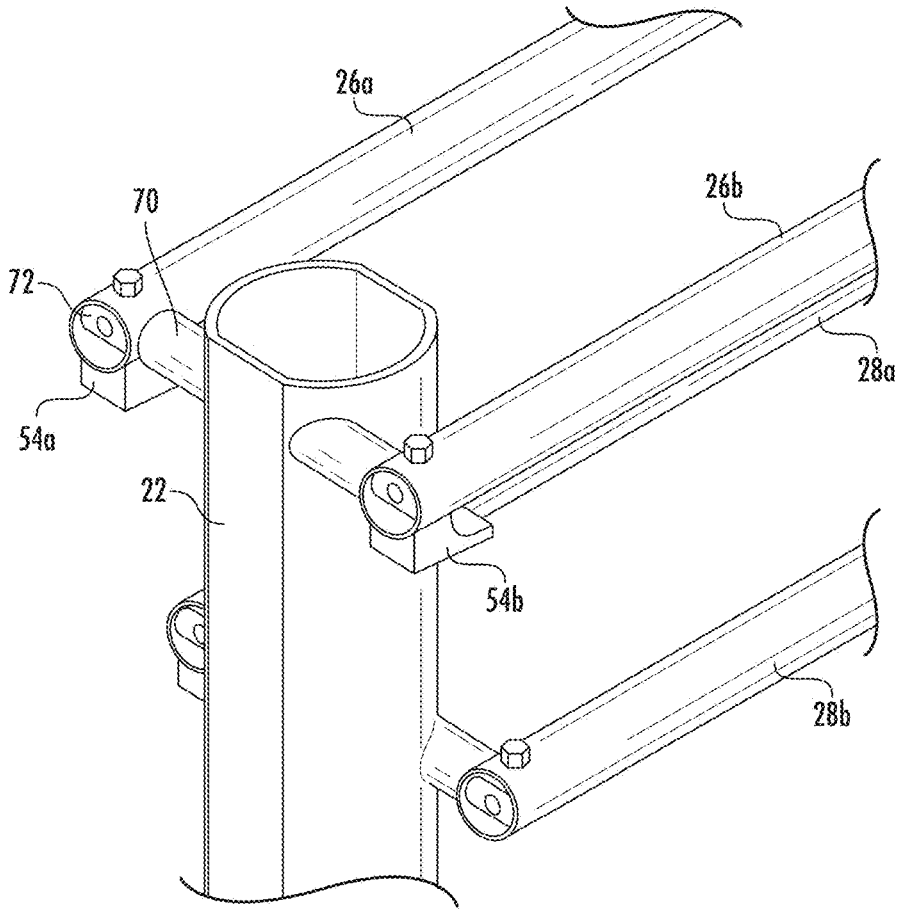
FIG. 4 is an enlarged perspective view of the proximal portion of the traffic gate of FIG. 1.

Referring again to FIGS. 1, 2 and 4, transverse hinges 66 and 68 are provided at pedestal 12 for pivoting the proximal ends of arms 16 and 18, respectively. In this embodiment, hinges 66 and 68 have an outer tubular element of shorter length, such as tubular element 70 (FIGS. 2 and 4), within which an inner tubular element of longer length, such as tubular element 72, is located. (One skilled in the art will appreciate that the outer tubular element need not be continuous along its entire length, but could be formed of spaced apart segments as shown in FIG. 4.) The inner tubular element thus has one or more end portions which extend beyond the ends of the outer tubular element for attachment to the proximal ends of arm elements 26*a-b* and 28*a-b*. As will be described below, one or both of the inner tubular elements may be desirably configured as a torsion spring.

FIG. 6 shows attachment of inner tubular element 72 to arm element 26*a*. As can be seen, this end of inner tubular element 72 extends through an aperture defined in the inside face of arm element 26*a*. Aligned holes in arm element 26*a* and inner tubular element 72 allow a transverse bolt 74 to extend completely therethough. As a result, at least the end portions of inner tubular element 72 will rotate with respect to outer tubular element 70 as arm 16 is raised and lowered. It may be desirable to provide a suitable protrusion on these end portions that moves within a corresponding slot defined in outer tubular element 70. This will limit the angular extent through which the arms can rotate. In a preferred embodiment, bolt 74 and the corresponding bolt on arm element 26*b* can also be used to retain respective bumpers 54*a* and 54*b*.

Bolt 74 defines a transverse hole 76 in its shank that aligns with a pair of diametrically opposed holes in inner tubular element 72. These holes allow insertion of tool 62 into arm element 26*a* when length adjustment is desired as described above. One skilled in the art will appreciate that similar features should be provided on arm elements 26*b* and 28*a-b* to facilitate length adjustment.

Figure 8:
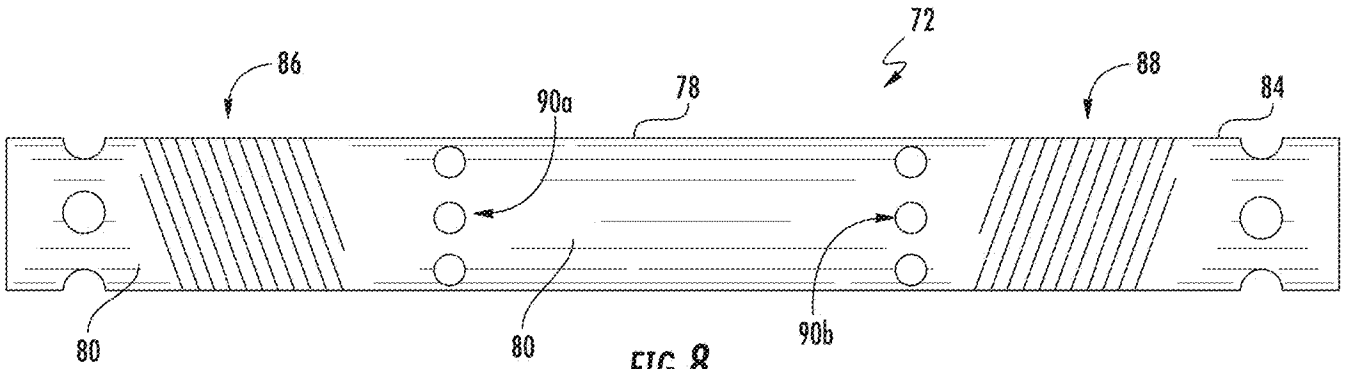
FIG. 8 is an elevational view of a preferred torsion spring element that can be used in the traffic gate of FIG. 1.

As noted above, one or both of the inner tubular elements used in the respective hinges can be formed as a torsion spring, or "tensioner." In this regard, FIG. 8 shows a torsion spring 78 formed of a single piece of tubular stock for use as inner tubular element 72. Along its axis, spring 78 includes a central portion 80 between end portions 82 and 84. As shown, the end portions 82 and 84 are separated from central portion 80 by respective cuts 86 and 88. Cuts 86 and 88, which are generally spiral, allow end portions 82 and 84 to rotate with respect to central portion 80. Such rotation stores energy that urges the tensioner back toward its at-rest position. This type of tensioner is disclosed in the context of a swinging gate in U.S. Pat. No. 9,032,666, incorporated fully herein by reference for all purposes.

Central portion 80 of spring 78 is suitably fixed with respect to the outer tubular element, such as by diametrically opposed holes defined therein. In the illustrated embodiment, for example, first and second series of holes 90*a-b* are spaced apart about the circumference of central portion 80. Each such hole is one of a pair of diametrically opposite holes, allowing an installer to select which pair will be used. This is advantageous because the installer can "preload" torsion spring 78 to achieve a desired amount of raising force on the pivotal arm assembly.

Figure 9:
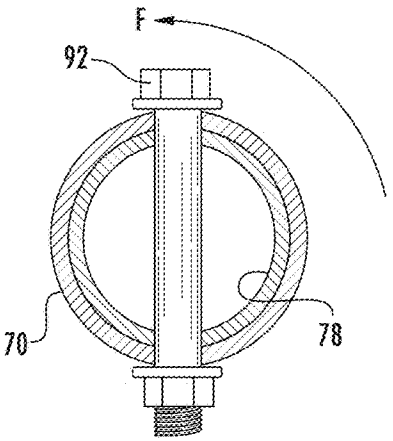
FIG. 9 is an enlarged fragmentary view showing loading of the torsion spring of FIG. 8 to facilitate raising of the arm assembly.

FIG. 9 shows a bolt 92 extending through outer tubular element 70 and a selected pair of diametrically opposed holes 90 in spring 78. Corresponding holes are defined in outer tubular element 70 to fix central portion 80 with respect to outer tubular element 70. Because spring 78 is preloaded, a force F is produced on the traffic gate assembly urging it to the raised position. This force is insufficient to actually raise the arms 16, 18 and foot structure 20, but will allow these components to be more easily raised by a user. For example, in a preferred embodiment, spring 78 is configured to allow lifting of a fully extended (e.g., twelve foot) traffic gate with less than 40 pounds of lifting force (e.g., 30 pounds of lifting force). As a result, a single individual can easily raise the entire gate assembly without motorized lift assist.

According to one preferred method, spring 78 can be preloaded by rotating both arms 16 and 18 past vertical to the back side of pedestal 12. (Foot structure 20 will need to be removed, and any stop mechanisms such as the protrusion and slot arrangement discussed above will also need to be removed or otherwise disabled so that this rotation can occur.) Because bolt 92 is not yet inserted, central portion 80 of spring 78 will rotate along with the end portions 82 and 84. Once arms 16 and 18 are in this position, bolt 92 can be secured through a pair of diametrically opposed holes 90 in central portion 80. After all of this is done, rotation of arms 16 and 18 back past vertical and to the lowered position will result in preloading of spring 78. (Foot structure 20 is then reattached and the angular stop mechanisms are again enabled.)

As noted above, one or both of hinges 66 and 68 may be equipped with torsion springs 78 depending on the amount of preloading desired, and possibly other factors. In a manually lifted gate with only one torsion spring, the second hinge may have a simple tube inside of the outer tubular element. Such a tube would freely rotate with the outer tubular element, possibly limited by a suitable angular stop mechanism. In some cases, however, it may be desirable to equip gate apparatus 10 so that its raising and lowering is mechanized. For example, in many cases, vehicles may be equipped with RFID or bar codes that automatically raise traffic gates as an authorized vehicle approaches.

Figure 10:
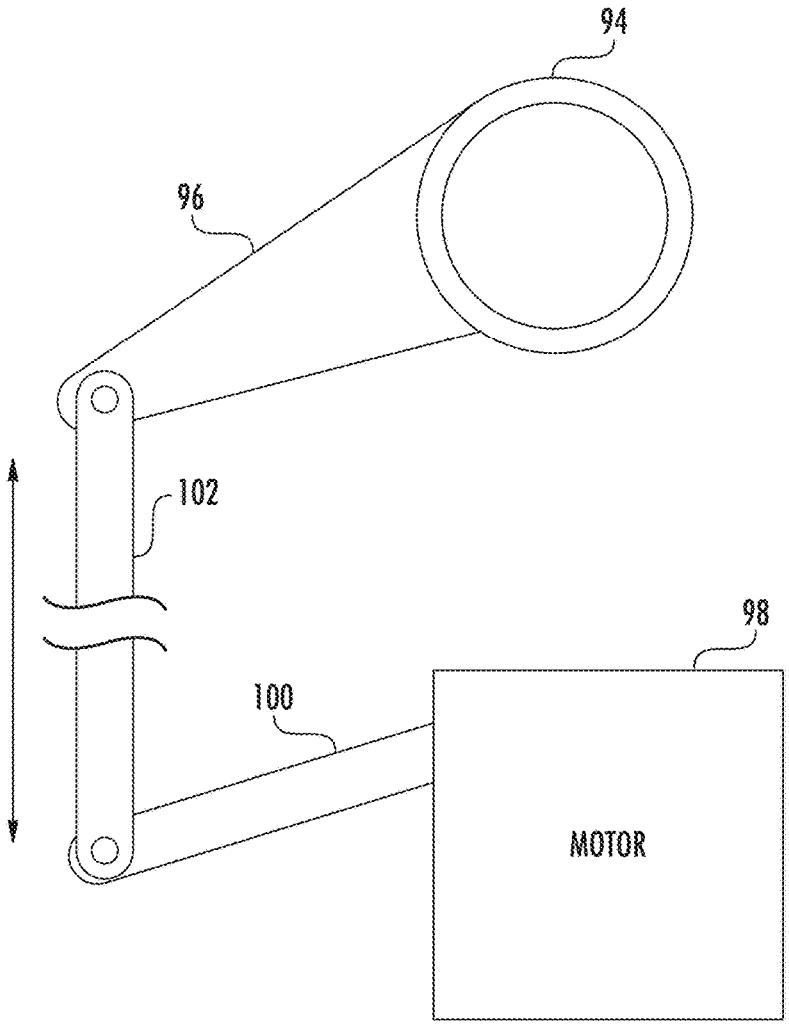
FIG. 10 diagrammatically illustrates a crank mechanism that can be used to raise and lower the pivotal arm assembly of the traffic gate of FIG. 1.

In this regard, FIG. 10 diagrammatically illustrates one mechanism for achieving automatic raising and lowering of gate apparatus 10. In this case, the hinge has an inner tubular element 94 having a crank arm 96 extending thereform. A suitable motor 98 also has a crank arm 100. A linkage 102 extends between crank arms 96 and 100 such that driven movement of crank arm 100 in a back and forth direction will cause corresponding movement of crank arm 96 (and thus rotation of inner tubular element 94). As one skilled in the art will appreciate, any suitable signal, such as bar code, RFID, numerical code, etc., can be used to activate motor 98. It many embodiments, it will be desirable to situate motor 98 inside of the pedestal's vertical housing portion 22 so that it is hidden from view.

Those skilled in the art should appreciate that the above description provides a novel traffic gate apparatus. While the above embodiments were described primarily in relation to vehicular traffic, it should be understood that embodiments of the present invention could be used to control foot traffic in addition to or instead of vehicular traffic. In the case of foot traffic, for example, the gate may include a mechanism (e.g., a motor-driven mechanism) which keeps the arm(s) in a raised position. A proximity sensor or other suitable triggering mechanism may be utilized to detect the approach of a person or conflicting cross-traffic, and lower the arm(s) when appropriate. Such an arrangement might be useful in a manufacturing plant or other location where people cross paths with vehicles.

Thus, while one or more preferred embodiments of the invention have been described above, it should be understood that any and all equivalent realizations of the present invention are included within the scope and spirit thereof. The embodiments depicted are presented by way of example only and are not intended as limitations upon the present invention. Moreover, it should be understood by those skilled in the art that the present invention is not limited to these embodiments since modifications can be made. Therefore, it is contemplated that any and all such embodiments are included in the present invention as may fall within the scope and spirit thereof.

What is claimed is:

1. A traffic gate apparatus comprising:

an upstanding pedestal;

a first elongate arm having a proximal end and a distal end, said proximal end of said first elongate arm being pivotally connected to said pedestal at a first pivot axis;

a second elongate arm having a proximal end and a distal end, said proximal end of said second elongate arm being pivotally connected to said pedestal at a second pivot axis, said second pivot axis being below said first pivot axis;

said first and second elongate arms being movable between a lowered position in which said first and second elongate arms are generally horizontal and parallel with said first elongate arm being above said second elongate arm, and a raised position; and said first and second elongate arms each having an adjustment mechanism such that a length thereof can be varied, wherein each of said first and second elongated arms are pivotally connected to said pedestal via corresponding first and second hinges, each of said hinges including an outer tubular element and an inner tubular element, said outer tubular element being fixed with respect to said pedestal and at least a portion of said inner tubular element being rotatable with respect to said outer tubular element, wherein said inner tubular element has an end portion that extends beyond said outer tubular element, a corresponding one of said first and second elongate arms being attached to said end portion, and wherein at least one of said inner tubular elements has a linkage connecting structure for allowing motorized operation.

2. A traffic gate apparatus as set forth in claim 1, further comprising a motor located in said pedestal and connected to said at least one of said inner tubular elements via a linkage.

3. A traffic gate apparatus as set forth in claim 1, wherein said length of said first and second elongate arms can be varied between about six feet and twelve feet.

4. A traffic gate apparatus as set forth in claim 1, wherein said first and second elongate arms each have an arm element of fixed length which is pivotally connected to said pedestal and a corresponding extendible portion movable with respect to said arm element so as to vary a length of said elongate arm.

5. A traffic gate apparatus as set forth in claim 4, wherein each of said first and second elongate arms comprises first and second arm elements and first and second extendible portions.

6. A traffic gate apparatus as set forth in claim 5, wherein said first and second extendible portions are interconnected via a respective connecting portion.

7. A traffic gate apparatus as set forth in claim 5, wherein said first and second arm elements and said first and second extendible portions are tubular, such that one of said first and second arm elements and a corresponding one of said first and second extendible portions are telescopically connected.

8. A traffic gate apparatus as set forth in claim in 4, wherein said arm elements and said extendible portions are telescopically connected.

9. A traffic gate apparatus as set forth in claim 8, wherein said extendible portions are slidably received in a corresponding one of said arm elements.

10. A traffic gate apparatus as set forth in claim 9, wherein said extendible portions each carry a compressible member on an end thereof which has an increased diameter when axially compressed such that when said compressible member is adjusted it will engage against the interior surface of the arm element to fix the arm element and extendible portion with respect to one another.

11. A traffic gate apparatus as set forth in claim 10, comprising a compressing fitting configured to adjust the compressible member by squeezing the compressible member in an axial direction so as to increase its diameter.

12. A traffic gate apparatus as set forth in claim 1, further comprising a foot structure pivotally connected to said distal ends of said first and second elongate arms.

13. A traffic gate apparatus as set forth in claim 1, wherein at least one of said inner tubular elements is configured as a torsion spring having a fixed portion adjacent to said end portion.

14. A traffic gate apparatus comprising:

an upstanding pedestal;

a first elongate arm having parallel first and second arm elements;

a first hinge at which proximal ends of said first and second arm elements are pivotally connected to said upstanding pedestal so as to pivot about a horizontal pivot axis;

said first hinge including an outer tubular element and an inner tubular element, said outer tubular element being fixed with respect to said pedestal;

said inner tubular element having first and second end portions extending beyond said outer tubular element, said first and second arm elements being attached to said first and second end portions of said inner tubular element; and said inner tubular element further having a central portion fixed with respect to said outer tubular element, said central portion being separated from said first and second end portions by respective cuts such that said inner tubular element forms a torsion spring, wherein said inner tubular element of said first hinge has a linkage connecting structure for allowing motorized operation.

15. A traffic gate apparatus as set forth in claim 14, wherein said cuts in said inner tubular element each have a generally spiral configuration.

16. A traffic gate apparatus as set forth in claim 15, wherein said central portion of said inner tubular element defines at least one series of spaced apart holes about a circumference thereof for adjusting a preload applied to said first elongate arm.

17. A traffic gate apparatus as set forth in claim 16, wherein said preload allows lifting of said first elongate arm with less than 40 pounds of lifting force.

18. A traffic gate apparatus as set forth in claim 14, further comprising a second elongate arm, said first and second elongate arms being generally horizontal and parallel in a lowered position, with said first elongate arm being above said second elongate arm.

19. A traffic gate apparatus as set forth in claim 18, wherein said second elongate arm is pivotally connected to said pedestal via a second hinge.

20. A traffic gate apparatus as set forth in claim 19, wherein said second hinge comprises a torsion spring.

21. A traffic gate apparatus as set forth in claim 19, wherein said second hinge comprises an outer tubular element and an inner tubular element rotatable with respect to said outer tubular element.

22. A traffic gate apparatus as set forth in claim 14, further comprising a motor located in said pedestal and connected to said inner tubular element via a linkage.

23. A traffic gate apparatus as set forth in claim 14, further comprising a foot structure pivotally connected to a distal end of said first elongate arm.

24. A traffic gate apparatus as set forth in claim 14, wherein said first elongate arm has an adjustment mechanism so that its length can be varied.

* * * * *